US005910345A

United States Patent [19]

Luban

[11] Patent Number: 5,910,345

[45] Date of Patent: Jun. 8, 1999

[54] METHOD OF COATING BULLETS

[76] Inventor: William Luban, c/o Pemco Consolidated Services, 20W420 Rooke Ct., Downers Grove, Ill. 60516-5168

[21] Appl. No.: 08/932,721

[22] Filed: Sep. 18, 1997

[51] Int. Cl.[6] ..... B06B 1/00

[52] U.S. Cl. ..... 427/600; 427/190; 427/201; 427/240; 427/318; 427/327; 427/435; 427/560; 427/601

[58] Field of Search ..... 427/560, 600, 427/601, 190, 201, 240, 318, 327, 435

[56] References Cited

U.S. PATENT DOCUMENTS 4,454,175 6/1984 Martin ..... 427/242
4,465,883 8/1984 Lopata et al. ..... 585/9
5,378,499 1/1995 Martin ..... 427/242
5,447,465 9/1995 Samsel et al. ..... 451/32

*Primary Examiner*—Bernard Pianalto
*Attorney, Agent, or Firm*—Wood, Phillips, VanSanten, Clark & Mortimer

[57] ABSTRACT

Deleterious effects of friction between bullets and the barrel of a firearm are reduced by improving the lubricity of the surface of the bullet by coating the same with molybdenum disulfide according to a method that includes heating the bullets to be coated to open the pores thereof and then agitating the bullets and molybdenum disulfide with an impacting instrumentality to drive the molybdenum disulfide against the bullet to be deeply absorbed therein. The bullets are also polished and burnished.

19 Claims, No Drawings

METHOD OF COATING BULLETS

FIELD OF THE INVENTION

This invention relates to the coating of bullets, and more specifically, to the coating of metal or copper jacketed bullets with molybdenum disulfide.

BACKGROUND OF THE INVENTION

In modern bullet firing firearms, metal bullets are expelled through the rifled barrel of the firearm as a result of a percussive charge being detonated on the side of the bullet opposite the discharge end of the barrel. For stability, the bullet is caused to rotate about its longitudinal axis by rifling within the barrel. As a consequence, frictional contact between the bullet and the barrel is substantial.

Further, bullets are typically made of metal with hunting bullets being formed of a lead body or core with or without jacketing by another metal as for example, a copper jacket. Military ammunition will typically use steel jacketed bullets, which are highly erosive.

In all events, the friction between the bullets traveling through the barrel and the barrel itself causes wear on the interior of the barrel which shortens its life and, at some point in time will begin to interfere with the accuracy of the firearm. Furthermore, barrel fouling frequently occurs from metal scraped from the surface of the bullet or the jacket as a result of the friction. Prolonged firing of the firearm without cleaning can result in a loss of accuracy when the barrel is fouled.

The peak pressure generated by the detonating charge is also affected by the frictional characteristics involved. The greater the friction between the bullet and the barrel, the higher the peak pressure. In order to achieve safety in the firearm, in many instances, the presence of high friction requires the use of a lesser charge in the cartridge so that peak pressure is reduced to a safe value. This may lead to lower bullet velocities which in turn means that bullet trajectory will become more curved.

To overcome these difficulties, it has long been recognized that lubricant may be applied to a bullet to reduce the friction. One lubricant that has been proposed is molybdenum disulfide. As a means of applying molybdenum disulfide, Martin, in U.S. Letters Pat. No. 4,454,175 issued Jul. 12, 1984, proposes placing molybdenum disulfide, the bullets to be coated, steel balls and a fibrous medium in a tumbler. The bullets are tumbled with the steel balls, molybdenum disulfide and/or the fibrous medium for 2–6 hours, dependant upon the thickness of the coating desired.

The resulting bullets are said to increase accuracy and to reduce metal fouling of the barrel. However, because of the long tumbling time, the process is extremely time consuming and not economically viable.

The present invention is directed to overcoming one or more of the above problems.

SUMMARY OF THE INVENTION

It is the principal object of the invention to provide a new and improved method of coating bullets so as to improve the lubricity of the bullet surface and thereby reduce the friction between the bullet and the barrel of the firearm in which the bullet is fired. More specifically, it is an object of the invention to provide a method for rapidly coating bullets with molybdenum disulfide to improve their lubricity.

An exemplary embodiment of the invention achieves the foregoing objects in a method of coating metal bullets that includes the steps of a) heating the bullets to be coated with powdered molybdenum disulfide to a temperature sufficient to open the pores of the bullets but insufficient to cause a change in shape of the bullets; b) contacting the heated bullets and molybdenum disulfide with an impacting instrumentality in a vibratory agitator to drive the molybdenum disulfide against the bullets to be deeply absorbed therein; and c) contacting the bullets and molybdenum disulfide with a polishing or burnishing agent.

In a preferred embodiment, steps b) and c) are performed simultaneously.

Preferably, the temperature to which the bullets and molybdenum disulfide is heated is in the range of about 180° F. to about 250° F. with 225° F. being a preferred temperature.

In one embodiment of the invention, the impacting instrumentality comprises a plurality of hard metal balls, preferably steel balls or copper coated lead balls.

In a preferred embodiment, the hard metal balls are of a size different than the bullets and more preferably, are at least slightly smaller than the bullets.

The invention contemplates that step c) be followed by the step of sieving the balls and the bullets to separate the same.

In one embodiment of the invention, the polishing or burnishing agent is a relatively soft, porous, organic material. Preferably, the polishing or burnishing agent is ground corn cob or ground walnut shells.

In a highly preferred embodiment, the bullets, the molybdenum disulfide, the impacting instrumentality and the polishing or burnishing agent are all heated together.

In one embodiment, the agitation step is performed for at least about 10 minutes.

The invention also contemplates the additional steps of placing bullets previously separated from the impacting instrumentality and the polishing or burnishing agent in a clean mass of ground corn cob and subjecting the bullets to additional vibratory agitation and thereafter removing the bullets from the corn cob of the additional step.

In a highly preferred embodiment, the coated bullets are baked to increase adhesion of the molybdenum disulfide. Preferably, the baking step is performed for about 15 minutes at a temperature in the range of 225° F.–270° F., with 255° F. being a highly preferred temperature.

Other objects and advantages of the invention will become apparent from the following specification.

DESCRIPTION OF THE PREFERRED EMBODIMENT

The method of the present invention will be described in connection with the coating of jacketed bullets. However, it should be appreciated that the invention is not so limited and may be used with efficacy in the coating of metallic bullets made of differing materials with and without jackets.

Molybdenum disulfide is coated onto the bullets to increase the lubricity of the surface of the bullet. Such an increase in lubricity will reduce the friction between the bullet and the barrel as the bullet is expelled through the barrel of a firearm.

In order to achieve this result, however, it is necessary that the molybdenum disulfide be thoroughly adhered to the bullet such that it cannot be readily removed. According to the invention, such adhesion is obtained by placing bullets of metal such as lead or steel, or jacketed bullets such as copper jacketed lead bullets in a suitable container in which a mixture of molybdenum disulfide, ground corn cob, and steel balls is present. The molybdenum disulfide will be powdered and may be either standard or technical grade. In the usual case, it will have a size in the range from about 0.5 microns to about 100 microns. There is no upper limit to the amount of molybdenum disulfide present. Enough should be placed in the mixture such that at the end of the coating process, an excess of molybdenum disulfide powder in the container will be visible to the operator.

The ground corn cob placed in the container at this stage of the process will typically be of any grade from number one to number three. Alternatively, other fibrous organic material can be used. Ground walnut shells is an example of such a material.

The steel balls used preferably are slightly smaller than the diameter of the bullets. For example, a 0.308 inch diameter bullet would require the utilization of steel balls of 0.300 inches or smaller. A 0.200 inch diameter ball might be used with bullets having a diameter of 0.224 inches. If desired, the steel balls could be somewhat larger than the bullets so long as they are not so large as to have a mass that upon contacting the bullets during vibrating agitation of the mixture would cause deformation of the bullet. The use of steel balls that are of smaller diameter than the bullets minimizes the possibility of deformation. The point in using steel balls of a diameter different than the bullets is to allow the separation of the bullets from the steel balls through the use of an ordinary sieve.

The corn cob serves as a polishing or burnishing agent while the steel balls act as an impacting instrumentality. In particular, the corn cob polishes the metal surfaces of the metal bullets to reduce RMS values as well as to burnish the molybdenum disulfide at the same time. This yields a strikingly shiny and highly reflective finish that is not unlike that of an electroplated surface. Other polishing or burnishing agents may be used. Ground walnut shells, as mentioned previously or even wood shavings may be employed if desired.

The steel balls are operative to drive the molybdenum disulfide against the surface of the bullets to cause its absorption to a substation depth therein. Other metal balls may also be used. For example, copper plated lead balls may be used.

In the usual case, the corn cob will be present at a volume of approximately two to three times the volume of the bullets while the quantity of the steel balls used would have a weight of about ⅓ to ¼ the weight of the bullets.

The mixture of bullets, molybdenum disulfide, corn cob and steel balls is placed in an oven and heated to a temperature in the range of about 180° F. to 250° F. with a preferred temperature being 225° F. At temperatures above 250° F., dissimilarity in the coefficients of thermal expansion of the lead core of the bullet and the metal forming the jacket can cause deformation of the bullet. For example, if the core has a higher coefficient of thermal expansion than the jacket, heating above 250° F. may cause the core material to literally extrude out of the nose of the bullet or break the bond between the core and the jacket upon being fired or cause premature jacket separation upon bullet impact.

The heating step is believed to open the pores in the metal bullet so as to allow rapid absorption of the molybdenum disulfide, deep into the metal of the bullet itself. This assures that the molybdenum disulfide is well adhered to the bullet to in turn assure that its lubricity characteristics will remain with the bullet throughout packaging, storage and firing of the bullet.

The heating step should be performed until the mixture has been heated throughout. Once that has occurred, the contents are promptly placed in a vibratory agitator. The vibratory agitator may be of conventional construction and typically will include an annular, horizontal, vibrating surface. The vibratory surface may be caused to vibrate by any suitable means, as for example, by rotating eccentric weights, by means of an electromagnet energized with alternating or pulsating current, etc. The mixture is deposited on the surface and subjected to vibratory agitation thereon. In many cases, the mixture will be conveyed about the annulus, moving both annularly and radially.

Though no limitation to any particular type of vibratory agitator is intended, one apparatus that works well for the purpose is a model 2094 vibratory agitator available from Midway Arms of Columbia, Mo.

A key point of the invention is the use of a vibratory agitator at this stage of the process. The prior art employs a tumbling drum and requires that the materials be tumbled within the drum for up to six hours. In contrast, the use of a vibratory agitator reduces the time of agitation required by a full order of magnitude, presenting a substantial time savings.

It is believed that this difference is due to two factors. In a tumbling drum, contact between the bullets, the molybdenum disulfide and the steel balls tends to be sort of a sliding type contact which promotes burnishing of the bullet surfaces but does not result in rapid penetration of the molybdenum disulfide into the pores of the bullet. In contrast, in a vibratory agitator, the molybdenum disulfide is literally "hammered" into the pores of the bullet by direct contact between the steel balls and the bullets themselves.

A second factor resides in the fact that in a vibratory agitator, contacts between a steel ball and a bullet will occur at a much higher rate than in a tumbling drum. In a tumbling drum, as the material is elevated up the side of the drum during rotation of the drum, it simply slides down towards the center or spills over a vane or the like. Contact will occur only between that part of the material that is spilling. There will be only minimal or virtually no contacts between components of that part of the material that is being elevated within the drum prior to its spilling. On the other hand, in a vibratory tumbler, because of the continual vibration, there will be continuing "hammering" contact because all of the material is constantly being subjected to vibration. Further, the rate of vibration itself causes a much greater number of contacts because if it is attempted to increase the number of contacts in a tumbling drum by increasing the rotational rate of the drum, a limit on rotational rate will be reached because the material, as a result of centrifugal force, simply embraces the interior surface of the drum and does not tumble at all.

It is also to be noted that the rapidity with which the vibratory agitation step may be performed according to the invention enhances the effect of the heating step. In the prior art process, unless the tumbling drum is heated, over the up to six hour tumbling, the materials will cool to the ambient and the benefits of heating will be lost early on in the agitation step. However, in the preferred embodiment of the applicant's invention, the relative shortness of the vibratory agitation step permits the materials to remain at an elevated temperature throughout the step to enhance the effectiveness of heating the mixture.

The mixture is subjected to the vibratory agitation for a period of time sufficient to uniformly coat the bullets. In the usual case, this will require at least about 10 minutes, to perhaps as many as 20 minutes or somewhat more, dependant upon the temperature of the mixture as it comes out of the heating step and is placed in the vibratory agitator. During the agitation step, the steel balls impact the molybdenum disulfide on the bullet surfaces and drive the same into the bullets themselves. Simultaneously, the corn cob polishes the metal surface of the bullets as well as burnishes the molybdenum disulfide, as mentioned previously.

The vibratory agitation step is completed when a sample extracted from the mass can be rubbed briskly with a paper towel. Upon inspection of both the bullet and the towel, it should be apparent that the molybdenum disulfide is adhering to the bullet. At this point, the bullets may be separated from the remaining molybdenum disulfide, the steel balls, and the corn cob through the use of a sieve as alluded to previously.

Following separation of the bullets from the remainder of the material, the bullets may then be placed in a clean mixture of ground corn cob of any grade for a final vibratory agitation finishing step. The final vibratory agitation step is typically performed over a period of time of two to about five minutes. At this time, inspection of the bullets by rubbing a sample on the skin should leave a bare trace of grayish residue, indicating that the molybdenum disulfide coating is adherent and cannot be readily removed. The bullets will appear to be a bright silvery color and will be very slippery to the touch.

In some cases, a baking step may be employed following the final vibratory agitation step. The bullets are placed in an oven at a temperature of about 225°–270° F. for about 15 minutes. A preferred temperature is 255° F. The baking step increases the adhesion between the bullets and the molybdenum disulfide apparently by again opening the pores in the bullets to allow additional penetration of the molybdenum disulfide.

The coated bullets may then be employed in finished cartridges in a conventional fashion.

Several benefits occur as a result of using bullets coated according to the invention. For one, there is a dramatic reduction in barrel fouling from surface metal of the bullets, particularly surface metal from the jackets of bullets. Field testing involving consecutive firing of high powered rifle bullets in excess of 300 rounds without cleaning the barrel did not reveal any build up of jacket and/or powder residues in the barrel and there was no loss of accuracy over the number of rounds.

The clearly reduced friction during bullet travel through the barrel reduces wear on the barrel and thereby lengthens the usable life of the barrel.

Because of the increased slipperiness of the bullets due to the reduced friction, peak pressures present in the barrel during the firing of the firearm are reduced which in turn allows a given firearm to fire cartridges loaded to achieve higher velocities, all the while maintaining safe pressures.

Bullets made according to the method of the invention may be fired with enhanced accuracy as a result of reduced variances in friction during firing. It also appears that the reduction in friction serves to dampen vibration of the barrel as the bullet travels through it, further enhancing accuracy.

Because of the lack of fouling, the firearms do not require cleaning as frequently.

It is expected that there will be an improvement in long range ballistics, i.e., bullet travel paths in excess of 300 yards, as a result of smoother air flow about the bullet due to the improved lubricity of its surface.

It is also expected that there will be improved penetration into a target, particularly when using hunting bullets, due to the increased lubricity of the bullet surface.

In repeating firearms, particularly semi-automatic firearms, improved reliability in feeding and chambering is to be expected again, due to the high lubricity of the surface of the bullet. It is also expected that there will be a lesser loss of accuracy for sustained firing of a firearm due to slower temperature rise of the barrel. In particular, because there will be less friction using bullets made according to the invention, less heat due to friction will be generated and the temperature rise rate of the barrel will be slower.

Furthermore, use of bullets made according to the invention results in part of the molybdenum disulfide coating transferring to the surface of the bore of the firearm barrel. As a result, the lubricity of the bore itself is increased and the benefits of the increased lubricity are lent to subsequently fired rounds. Bullet to bullet firing variations are progressively reduced with continued use of bullets made according to the invention.

It will therefore be appreciated that bullets made according to the invention possess substantial advantages over those heretofore known.

I claim:

1. A method of coating metal bullets comprising the steps of:

a) heating the bullets to be coated to a temperature sufficient to open the pores thereof but insufficient to cause a change in shape of the bullets with powdered molybdenum disulfide;

b) contacting the heated bullets and molybdenum disulfide with an impacting instrumentality in a vibratory agitator to drive the molybdenum disulfide against the bullets to be deeply absorbed therein; and c) contacting the bullets and molybdenum disulfide with a polishing or burnishing agent.

2. The method of claim 1 wherein steps b) and c) are performed simultaneously.

3. The method of claim 1 wherein said temperature is in the range of about 180° F. to about 250° F.

4. The method of claim 1 wherein said impacting instrumentality comprises a plurality of metal balls.

5. The method of claim 4 wherein said metal balls are of a size different than said bullets.

6. The method of claim 5 wherein said metal balls are at least slightly smaller than said bullets.

7. The method of claim 5 wherein step c) is followed by the step of sieving said balls and said bullets to separate the same.

8. The method of claim 1 wherein said polishing or burnishing agent is a relatively soft, porous, organic material.

9. The method of claim 8 wherein said polishing or burnishing agent is ground corn cob.

10. The method of claim 1 wherein said bullets and said molybdenum disulfide are heated with said impacting instrumentality.

11. The method of claim 1 wherein said bullets and said molybdenum disulfide are heated with said polishing or burnishing agent.

12. The method of claim 1 wherein said bullets, said molybdenum disulfide, said impacting instrumentality and said polishing or burnishing agent are heated together.

13. The method of claim 1 wherein step c) is followed by the step of baking the bullets at an elevated temperature.

14. A method of coating metal or metal jacketed bullets comprising the steps of:

a) heating the bullets to be coated with metal balls of a size smaller than said bullets, molybdenum disulfide particles of a size in the range of about 0.5 to about 100 microns, and a polishing or burnishing agent to a temperature in the range of about 180° F. to about 250° F.;

b) thereafter, subjecting the bullets, the molybdenum disulfide, the balls and the agent to vibratory agitation for a period of time sufficient to uniformly coat the bullets; and c) separating the bullets from the balls and the polishing or burnishing agent.

15. The method of claim 14 wherein step b) is performed for at least about 10 minutes.

16. The method of claim 14 wherein step c) is performed with the use of a sieve.

17. The method of claim 14 wherein the temperature is about 225° F.

18. The method of claim 14 wherein step c) is followed by the step of baking the bullets at a temperature in the range of about 225°–270° F.

19. A method of coating metal or metal jacketed bullets comprising the steps of:

a) heating the bullets to be coated with hard metal balls of a size smaller than said bullets, molybdenum disulfide particles of a size in the range of about 0.5 to about 100 microns, and ground corn cob to a temperature in the range of about 180° F. to about 250° F.;

b) thereafter, subjecting the bullets, the molybdenum disulfide, the balls and the corn cob to vibratory agitation for at least about 10 minutes to uniformly coat the bullets;

c) separating the bullets from the balls and the corn cob by placing the materials on a sieve;

d) placing the separated bullets into a clean mass of ground corn cob and subjecting the bullets to additional vibratory agitation;

e) removing the bullets from the corn cob of step d); and f) baking the bullets at a temperature in the range of about 225° F. to about 270° F. for several minutes.

* * * * *